United States Patent [19]

Burke

[11] Patent Number: 4,793,029

[45] Date of Patent: Dec. 27, 1988

[54] TILTABLE BUTTON HAVING ANTI-ROTATION MEANS

[75] Inventor: James E. Burke, Huntington, Conn.

[73] Assignee: Scovill Fasteners Inc., New York, N.Y.

[21] Appl. No.: 157,534

[22] Filed: Feb. 19, 1988

[51] Int. Cl.[4] ..... A44B 1/12

[52] U.S. Cl. ..... 24/113 MP; 24/90 R; 24/90 C

[58] Field of Search ..... 24/113 MP, 90 A, 90 C, 24/90 E, 90 R, 90 F, 94, 95, 92, 108, 103, 109, 113 R, 104, 691, 692, 682, 688, 687, 689, 102 PL

[56] References Cited

U.S. PATENT DOCUMENTS

| | | | |
|---|---|---|---|
| 2,073,422 | 3/1937 | Komorous | 24/113 MP |
| 2,261,285 | 11/1941 | Purinton | 24/90 E X |
| 2,461,324 | 2/1949 | Huelster | 24/95 |
| 2,902,735 | 9/1959 | Holdsworth | 24/105 |
| 3,028,646 | 4/1962 | Janes | 24/94 X |
| 3,249,974 | 5/1966 | Connolly | 24/113 MP |
| 4,541,148 | 9/1985 | Watanabe | 24/92 X |
| 4,570,307 | 2/1986 | Kanzaka | 24/90 C X |

*Primary Examiner*—Kenneth J. Dorner
*Assistant Examiner*—Laurie K. Cranmer
*Attorney, Agent, or Firm*—Dallett Hoopes

[57] ABSTRACT

A tiltable button comprises a shank and cover or shell. The shank and shell between them have means to prevent relative rotation. In one form the shank has radial recesses and the shell inward deflections which go into the radial recesses. In another form the shank has spokes which go out to a ring over which the shell is crimped, the spokes permitting tilting of the shell but not rotation relative to the shank. Anti-rotation projections are formed downwardly on the bottom of the shank. The purpose of preventing rotation is so that logos and other indicia on the shell will always be right side up.

8 Claims, 1 Drawing Sheet

TILTABLE BUTTON HAVING ANTI-ROTATION MEANS

BACKGROUND OF THE INVENTION

1. Field of the Invention

This invention relates to tiltable buttons for apparel and the like. More specifically, this invention relates to tiltable buttons which are designed to be imprinted with a legend on their face and are provided with anti-rotation means so the legend is always properly oriented, that is, right side up.

2. Description of the Art

In the prior art there are showings of buttons which have shanks which are riveted to clothing and the like, and have tops which tilt in order to assist in the buttoning and unbuttoning operation. However, such fasteners do not take into consideration the fact that some buttons bear logos written across them and hence must be right side up to be properly readable.

SUMMARY OF THE INVENTION

The present invention provides anti-rotation means for the top of a button with respect to its shank. The invention is disclosed in two versions.

In one the shank is formed with a bulbous head having radial recesses thereabout. The shell of the button with its appended collar is a separate piece tiltably mounted on the bulbous head of the shank, and the collar is formed with inward dimples which fit into the recesses described above and thereby keep the shell or top of the button from rotating.

An alternate embodiment has the shank formed with outward spokes at its top. The spokes are attached to a ring snugly disposed in the perimeter of the shell and collar. The collar is indented into a recess in the ring. Preferably the spokes are in the form of flat, spaced, short, radial sections extending outward from the top of the shank and short, radial sections extending inward from the ring and arcuate connectors connecting the short sections. The arcuate connectors of the spokes are also flat.

BRIEF DESCRIPTION OF THE DRAWINGS

Other features of the invention are disclosed in the following specification which refer to the drawings, all of which present non-limiting preferred embodiments of the invention. In the drawings.

DESCRIPTION OF THE PREFERRED EMBODIMENTS

Figure 1:
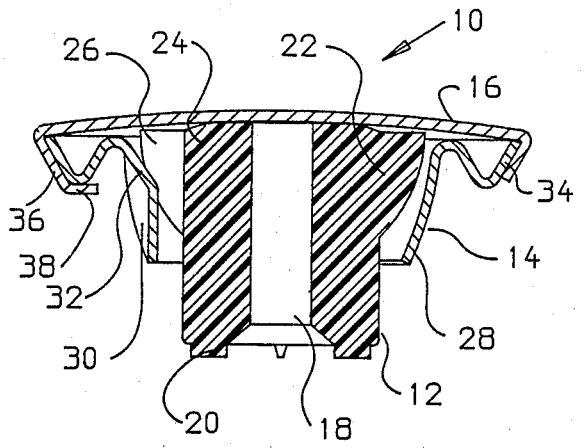
FIG. 1 is a sectional view of a button embodying the invention.

A button embodying the invention is generally designated 10 in FIG. 1. It comprises a shank 12, a collar 14 and a shell or cover 16.

The shank is generally cylindrical having an axial bore 18 for reception of a barbed rivet. Spaced, radial anti-rotation ribs 20 are provided on the bottom end of the shank for engagement with the clothing after installation of the rivet in bore 18. Ribs 20 prevent the shank 12 from rotating.

The upper portion of the cylindrical shank is bulbous as at 22 and provided with a flat upper surface 24. Radial recesses 26 are formed in the bulbous portion 22 for reasons which will be apparent.

The collar 14 has an inwardly curved lower apron 28 which engages the bulbous portion 22 of the shank. As shown at 30, the collar is provided with an inward deflection or detent which fits into the recess 26.

Above the apron the collar is deflected downward in an intermediate annular run 32 and then up again in a distal run 34 to terminate in an upwardly-facing edge. The shell or cover or top 16 is then crimped about the distal run 34 as at 36, and an inward tab or finger 38 may be provided for orienting the top on automatic setting machinery.

Figure 2:
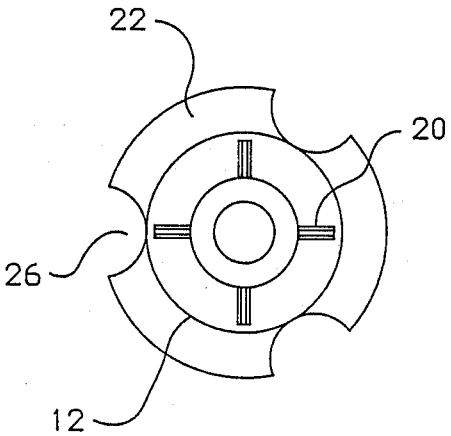
FIG. 2 is a button plan view of a shank as depicted in FIG. 1.

FIG. 2 is a bottom view of the shank 12, which includes the recesses 26 and the downward projections 20 as well as the bulbous head 22.

MODIFICATION

Figure 3:
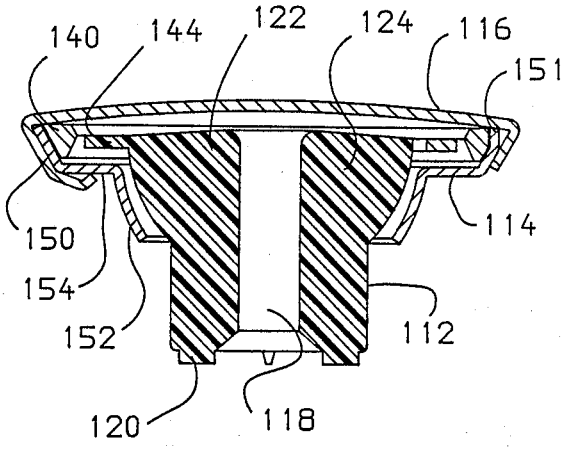
FIG. 3 is a sectional view of a modification of the button.

Referring now to FIG. 3, the shank 112 is provided with a collar 114 and a shell cover or top 116. As with the earlier embodiment, the shank includes a bulbous head 122, an internal bore 118, downward projections 120 and a generally flat upper surface 124.

Figure 4:
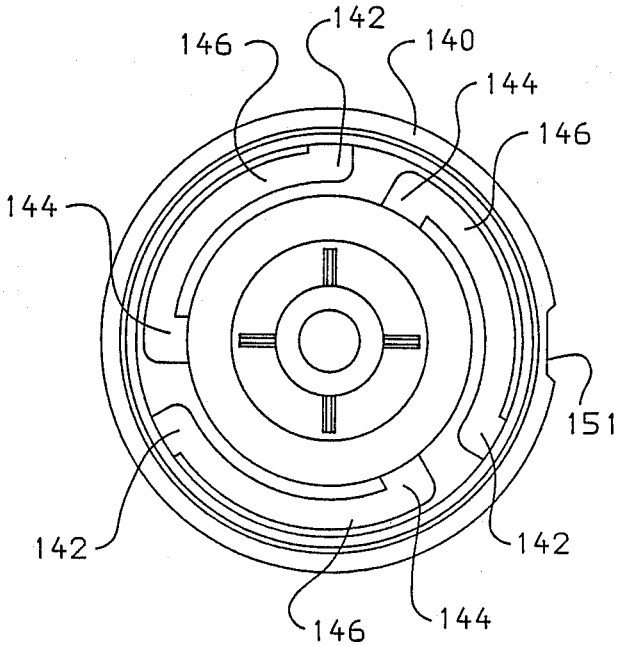
FIG. 4 is a top view of a shank with its spokes and ring as shown in FIG. 3.

As best shown in FIG. 4, the shank 112 is formed with spokes and an outer ring 140. The spokes each comprise short inward sections 142 extending in from the ring and short radial outward sections 144 extending outward from the body of the shank. These radial sections are not aligned but are connected with arcuate connectors 146. The spokes are relatively thin in the vertical dimension so that they are flexible and permit the ring 140 to tilt relative to the shank 112. The spokes are flat; that is, relatively greater in horizontal dimension than in vertical dimension so that the cover can tilt but not rotate.

The ring 140 is shaped to conform to the outwardly flaring distal run 150 of the collar 114. Run 150 is deflected inward into recess 151 in the ring to prevent rotation. A lower run 152 conforms generally to the outer surface of the bulbous portion 122, and a flat intermediate run 154 is provided in both.

The cover 116 is crimped about the upper run 150 of the collar and holds the ring 140 in fixed relation so that there is no rotating of the cover or shell 116 on the shank 112. A finger may be provided for automatic registration purposes as shown.

It can be seen that with either version described above the cover 16 or 116 respectively may not rotate with respect to the shank 12 or 112, and once the shank is installed on the clothing by a tightly installed rivet, there is no rotary movement of the shank, thanks to the anti-rotational projections 120, and hence the shell does not rotate relative to the clothing.

The invention may be presented in a number of other embodiments and hence it is not limited by the above-disclosed forms. The invention is therefore defined by the following claim language or equivalents thereof.

I claim:

1. A button comprising a rigid molded shank defined by a cylindrical lower portion having formed on its bottom at least one downward fabric-engaging projection offset from the center of the shank and a bulbous upper portion having a uniformly curving outward and upward side wall and a generally flat top; a collar loosely surrounding the upper end of the shank and having a contour on its inner surface generally proximate and complementing the bulbous upper portion of the shank; and a shell covering the top of the shank and crimped over the outer perimeter of the collar, and stabilizing means for limiting the rotary movement of the shell and collar with respect to the shank and whereby the shell and collar can tilt relative to the top of the shank but are held up in their center by the top of the rigid shank, and whereby the shell and collar are restrained from rotating relative to the shank.

2. A button as claimed in claim 1 wherein the stabilizing means comprises a radial recess in the bulbous upper portion and a radially inward deflection in the collar extending into the recess.

3. A button as claimed in claim 1 wherein the stabilizing means comprises a molded ring disposed outward from the top of the bulbous upper portion, the ring having an inward recess in its outer periphery and the ring being disposed snugly between the shell and the collar, the collar being indented into the ring so that the ring and the shell are fixedly related, and plastic spokes extending outward from the top of the bulbous upper portion and inward from the ring and molded integrally with the shank and ring, the spokes being greater in horizontal dimension than vertical dimension.

4. A button as claimed in claim 3 wherein the spokes comprise a plurality of spaced short outer radial sections extending inward from the ring and a plurality of spaced short inner radial sections extending outward from the top of the shank, selected inner and outer sections which are radially offset being connected by arcuate connector means.

5. A button as claimed in claim 4 wherein the spokes are thin and permit tipping of the ring relative to the shank.

6. A button comprising a plastic shank having a ring outward from its upper end and flexible spokes connecting the ring and shank and molded integrally therewith, the top of the shank, the spokes and the ring all being generally in the same plane, and a shell fixed on the ring with respect to rotary movement, the spokes permitting limited tilting movement of the shell on the shank.

7. A button as claimed in claim 6 wherein the spokes each meander in their travel from the shank to the ring.

8. A button as claimed in claim 6 wherein the spokes are thinner in cross section in the vertical direction than in the horizontal direction.

* * * * *